United States Patent [19]

Radclyffe

[11] Patent Number: 4,915,532

[45] Date of Patent: Apr. 10, 1990

[54] CONNECTOR FOR 3-DIMENSIONAL FRAME STRUCTURES

[76] Inventor: Simon P. Radclyffe, 57 Bientham Way, Ealing, London, England, W5 1BE

[21] Appl. No.: 119,851

[22] Filed: Nov. 12, 1987

[30] Foreign Application Priority Data

Nov. 13, 1986 [GB] United Kingdom ..... 8627117

[51] Int. Cl.[4] ..... F16B 7/00

[52] U.S. Cl. ..... 403/171; 403/176; 403/170; 403/218

[58] Field of Search ..... 403/175, 176, 173, 171, 403/170, 218, 264, 255, 252, 190, 381, 178, 174, 172, 217, 187

[56] References Cited

U.S. PATENT DOCUMENTS

| | | | |
|---|---|---|---|
| 1,679,758 | 8/1928 | Bauersfeld et al. | 403/174 |
| 2,683,329 | 7/1954 | Kobler | 403/218 X |
| 3,148,539 | 9/1964 | Cook . | |
| 3,476,421 | 11/1969 | Torres . | |
| 3,867,048 | 2/1975 | Endzweig | 403/264 X |
| 3,982,841 | 9/1976 | Endzweig | 403/171 X |
| 3,986,316 | 10/1976 | Blodee | 403/176 X |
| 4,194,851 | 3/1980 | Littlefield | 403/218 |
| 4,474,490 | 10/1984 | Harper, Jr. | 403/172 X |
| 4,501,512 | 2/1985 | Hiltz | 403/170 |

FOREIGN PATENT DOCUMENTS

| | | | |
|---|---|---|---|
| 0164271 | 12/1985 | European Pat. Off. . | |
| 1088334 | 9/1960 | Fed. Rep. of Germany | 403/175 |
| 2457674 | 6/1976 | Fed. Rep. of Germany | 403/176 |
| 2059876 | 6/1971 | France . | |
| 2136936 | 12/1972 | France . | |
| 2250395 | 5/1975 | France . | |
| 2350542 | 12/1977 | France . | |
| 2390613 | 1/1979 | France | 403/171 |
| 2400135 | 3/1979 | France . | |
| 2494353 | 5/1982 | France . | |

*Primary Examiner*—Peter M. Cuomo

*Attorney, Agent, or Firm*—Killworth, Gottman, Hagan & Schaeff

[57] ABSTRACT

A connector for connecting structural members such as panels, rods and tubes, to form a three-dimensional structure, comprises a connector body with a pair of axial slots at opposite ends thereof shaped to receive and retain tongues on the ends of the structural members and at least one annular channel extending around the connector body to receive similar tongues of further structural members extending in directions transverse to those in the axial slots. The axial slots and the channel have constrictions adjacent the outer surface of the connector body to retain tongues having widened free ends which are elongate in end view.

7 Claims, 7 Drawing Sheets

Fig.7a
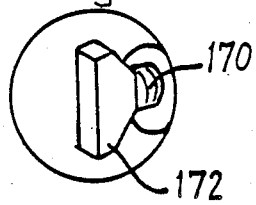
Fig.7
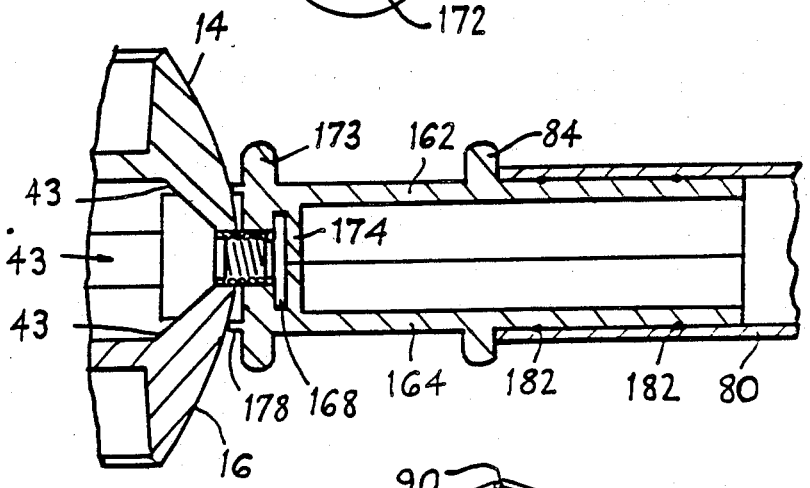
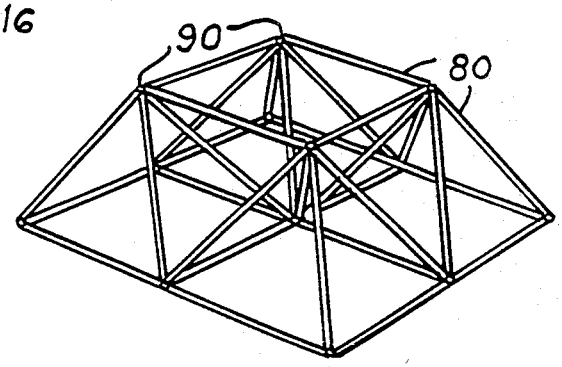
Fig.8
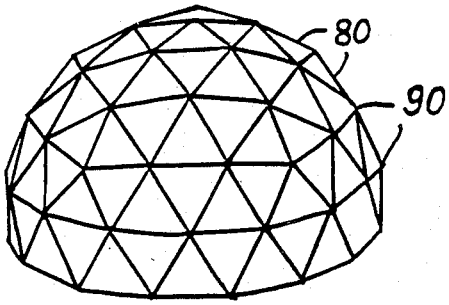
Fig.9

Fig10
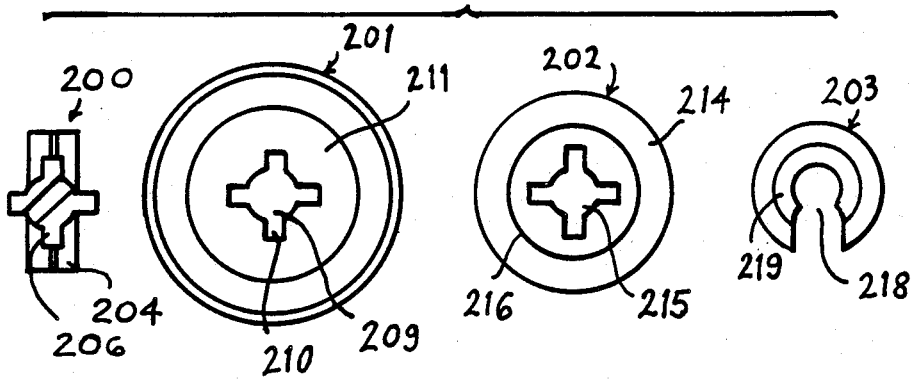
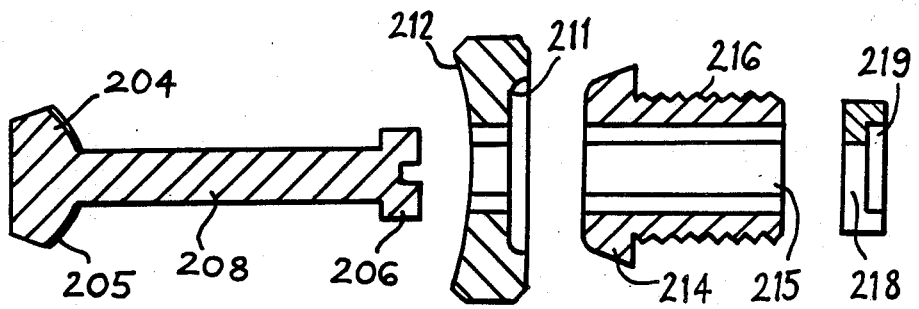
Fig.11
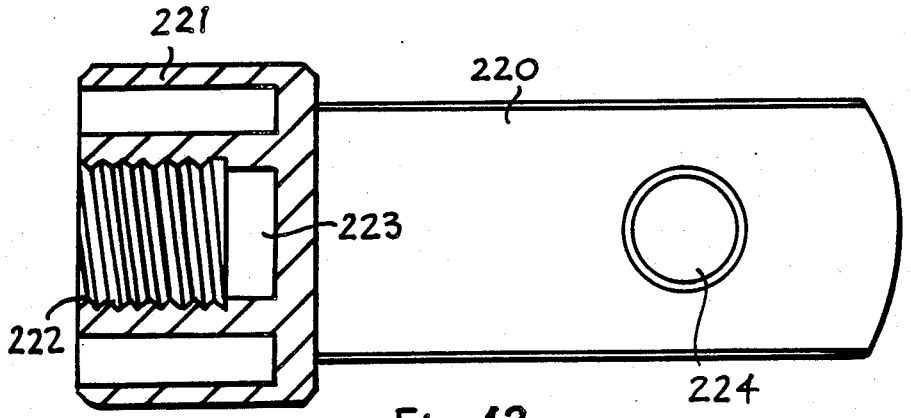
Fig.12

CONNECTOR FOR 3-DIMENSIONAL FRAME STRUCTURES

BACKGROUND OF THE INVENTION

1. Field of the Invention

This invention relates to a connector for use in building 3-dimensional structures, connecting structural members such as elongate tubes or rods and/or panels.

2. Description of the Prior Art:

There has been a considerable increase in recent years in the use of spaceframes - three dimensional structures wherein elongate, and often flexible, rods or tubes are connected together by connecting members or 'nodes', and wherein each such connecting member may have several rods or tubes radiating from it in different directions. Panels can also be connected in this way. The components of such frames are usually made from lightweight materials such as plastics or aluminium. A particularly useful type of structure is the triangulated type from which a wide range of shapes such as domes and spheres can be made. Examples of known connectors are shown in EP-A No. 0164271, FR-A No. 2059876 and U.S. Pat. No. 3,148,539.

Connecting members which can connect a large number of structural members extending in three dimensions at a wide range of angles tend to be made up of a large number of parts, making them complicated to assemble. It is also necessary in many cases to take each connector apart in order to attach the structural members to its.

SUMMARY OF THE INVENTION

It is accordingly an object of the invention to provide a connector which is cheap to make and easy to assemble, and with which a wide range of structures can be made, connecting the structural members without the need to disassemble the connector.

The present invention consists in a connector for connecting structural members such as panels, rods and tubes to form a 3-dimensional structure, comprising a connector body with a pair of axial slots at opposite ends thereof shaped to receive and retain tongues on the ends of the structural members, and at least one annular channel extending around the connector body to receive tongues of further structural members extending in directions transverse to those in the axial slots, wherein the axial slots and the channel have constrictions adjacent the outer surface of the connector body to retain tongues having widened free ends which are elongate in end view.

The invention also comprises a 3-dimensional structure wherein a plurality of structural members such as rods, tubes or panels are connected together by means of connectors of the type described above.

The connector of the invention is preferably of essentially spherical shape, with slots at diametrically opposed positions and a circumferential channel extending around the connector body, midway between the two slots and symmetrical about a plane perpendicular to the diameter on which the two slots are aligned.

The connector preferably also has two further annular channels, on either side of the first said channel, to accommodate further elongate members projecting at angles of about 45° relative to those projecting from the first said channel and from the diametrically opposed slots.

In a preferred from the connector of the invention includes a core separable into two portions, the core comprising an essentially cylindrical portion having at each end a part-spherical portion, wider than the cylindrical portion, in which is formed one of the diametrically opposed slots. Three channels are defined by a pair of annular members surrounding the cylindrical part of the core, a main channel being defined between the two annular members and two secondary channels being defined between the part-spherical core ends and respective adjacent annular members.

The connector of the invention can be used for example to connect tubes which are slid onto intermediate cylindrical connectors having tongues at one end to engage in the slots or channels defined above. The tongues are preferably wedge shaped and attached to the intermediate connectors by resilient means such as coil springs.

BRIEF DESCRIPTION OF THE DRAWINGS

Further objects and advantages of the present invention will become apparent from the following detailed description, taken in conjunction with the accompanying drawings which illustrate preferred embodiments of the invention.

In the Drawings:

FIG. 7 shows in cross-section an alternative form of intermediate connector;

FIG. 7*a* shows a detail of FIG. 7 in perspective view;

FIGS. 8 and 9 show examples of the kind of structure which can be made using the connectors of the invention;

FIG. 10 shows an end-on view of the parts of an alternative form of connecting tongue assembly for use with the connector of the present invention;

FIG. 11 is an axial cross-sectional view of the parts of the assembly of FIG. 10;

FIG. 12 is a part-sectional view of a panel connector for use in conjunction with the assembly of FIGS. 10 and 11;

DETAILED DESCRIPTION OF THE PREFERRED EMBODIMENTS

Figures 1, 1A:
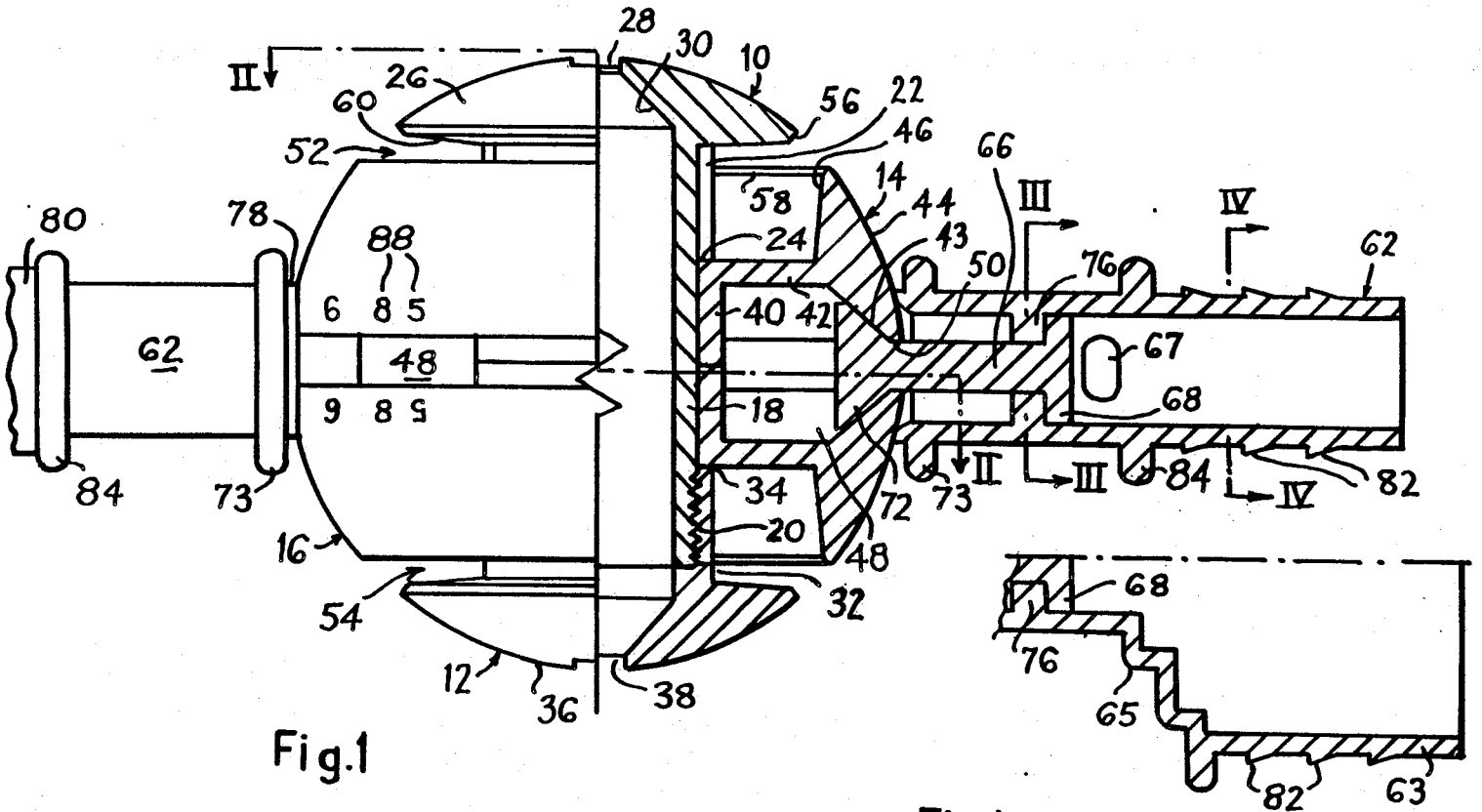
FIG. 1 shows, partly in elevation and partly in cross-section, a spherical connector in accordance with the invention and two intermediate connectors attached to it to support tubular structural members.
FIG. 1*a* shows in partial cross-section an alternative form of intermediate connector.
Figure 2:
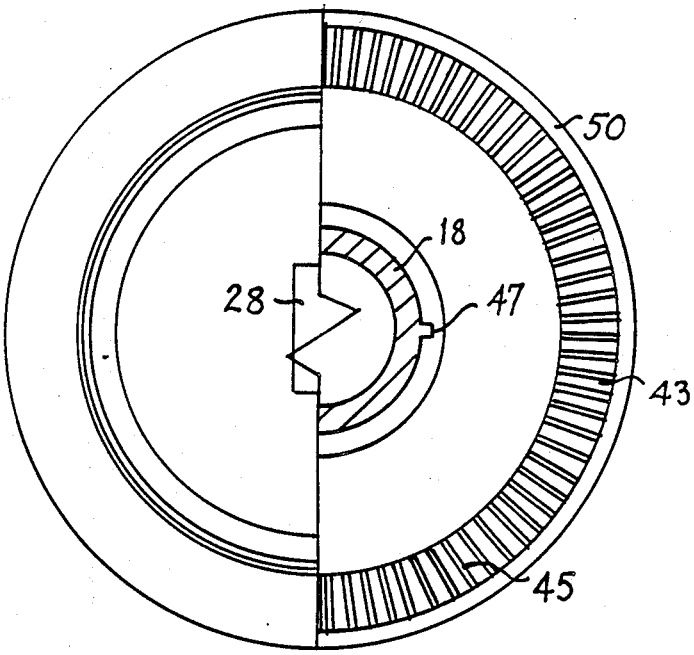
FIG. 2 is a part sectional view, on the line II—II of the spherical connector of FIG. 1 with the intermediate connectors omitted.

Referring first to FIGS. 1 and 2, a spherical connector is made up of two core members 10,12 threadedly connected together and two identical annular members 14,16 surrounding the core formed by members 10,12. These components are suitable made from plastics material, and their shape is such that they can easily be made by injection moulding. Alternatively, for a stronger system, they could be spun from aluminium.

The core member 10 comprises a hollow cylindrical shank 18 having an outer threaded portion 20 at one end. The other end has integrally-moulded longitudinal spacing bars 22, the ends 24 of which retain the annular member 14 in position. On the end of the shank remote from the threaded portion is a part-spherical head 26 forming part of the spherical surface of the connector. An elongate rectangular slot 28 is formed in the head 26 to receive a tongue of an intermediate connector or structural member as will be described below. The slot 28 communicates with the hollow interior of the shank, and a tapering inner surface 30 extends from the slot 28 to the cylindrical inner wall of the shank, forming a bearing surface against which a connector tongue abuts.

The core member 12 has a cylindrical hollow shank 32 which is shorter than shank 18 and has an inner screw thread by means of which the two core members are screwed together to form a symmetrical core. The axial end 34 of the shank 32 forms an abutting surface facing the axial ends 24 of spacing bars 22. The core member 12 also has a part spherical head 36 with a slot 38, identical to those on the core member 10, so that structural elements of a spaceframe can be connected to opposite ends of the core.

Surrounding the core are the annular members 14,16, which are held against axial movement between the spacing bars 22 and the end of the shank 32. Each of these annular members comprises a cylindrical inner portion 40 which fits around the cylindrical shank 18, an annular flange 42 extending radially outward from one end of the inner portion 40 and an outer portion 44 having a part-spherical outer surface, a frusto-conical inner surface 43 and a cylindrical or slightly flared inner surface 46. The inner surfaces 43 define between them part of a circumferential channel 48 which can accommodate tongues 72 of several spaceframe elements, extending radially outwardly at right angles to those accommodated in slots 28,38. Serrations 45 as shown in FIG. 2 may be formed on the surfaces 43, to assist secure location of the tongues 72, by engaging corresponding ridges on the tongue. The opposed outer edges of this channel are defined by flat annular surfaces 50 on each of elements 14,16, between the inner surface 43 and the part-spherical outer surface. The annular members are preferably held against rotation around the core by longitudinal keys 47 (FIG. 2) on the core engaging in corresponding slots in the inner surfaces of the annular members.

Two further annular channels 52,54 are defined between the heads 26,36 of the core members and the respective adjacent annular members 14,16. These channels can accommodate further spaceframe members extending at angles of about 45° to those held in the channel 48 or slots 28,38. The outer edges of these channels are defined by opposed frusto-conical surfaces 56,58. The surfaces against which the tongues will abut are the inner surface 46 of the annular member and the underside 60 of the core head 26 or 36, which surfaces may also be serrated like the surfaces 43.

The connector is assembled by sliding the two annular members 14,16 onto the cylindrical shank 18 of the core member 10 and screwing the other core member 12 onto the threaded portion 20 of the shank 18.

Figure 4:
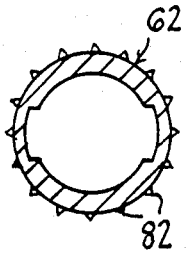
FIG. 4 is a cross-sectional view on the line IV—IV in FIG. 1.
Figure 3:
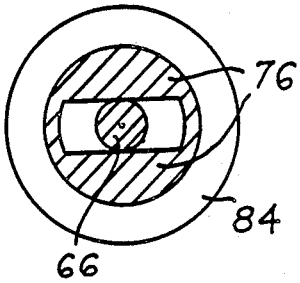
FIG. 3 is a cross-sectional view on the line III—III of the intermediate connector of FIG. 1.

Two intermediate connectors 62 for tubes are shown in FIGS. 1,3 and 4, one being shown with a tube 80 attached to it and the other being shown in cross-section. These connectors are essentially cylindrical and may suitably be made from aluminium or injection-moulded plastics. Near one end of each connector 62 is formed a pair of thick inwardly-extending annular flanges 76.

A unitary joint 66 made of hard rubber or other resilient material connects the intermediate connector 62 to the spherical connector. This joint is elongate and has at one end a cross piece 68, which engages behind the flanges 76, and at the other end a tongue 72 which is in the form of a wedge-shaped prism, similar to that shown in the inset in FIG. 7. Being of elongate configuration, the tongue can be inserted into any of channels 48,52,54 and retained there by rotating it through 90° so that it engages the inner surfaces such as 43. The cylindrical connector has an annular end portion 78 which surrounds the coil joint 66 and abuts the spherical connector surface. Behind the end portion 78 is an annular strengthening flange 73.

An elongate frame member in the form of a tube 80 is fitted over the left hand cylindrical connector, as shown in FIG. 1, integral projections 82 providing a friction fit to retain the tube in position, and the end of the tube abuts an annular flange 84 surrounding the cylindrical connector.

Apertures such as 67 may be provided in the walls of cylindrical connectors 62, to enable the tubes 20 to be used as wiring conduits.

Tubes of different diameter can be connected using the connector of FIG. 1, simply by using intermediate connectors whose cylindrical parts are of different diameter but which have the same tongue and joint arrangement. An example of such a connector is shown in FIG. 1*a*. This connector has a cylindrical portion 63 which is much wider than that of FIG. 1, connected by shoulders 65 to a tongue-supporting part which has the same dimensions as that of FIG. 1.

Figure 5:
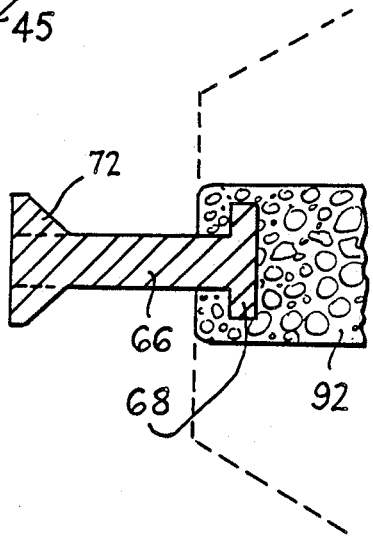
FIG. 5 shows in cross-section and in broken lines respectively two ways in which a panel may be attached to the connector of the invention.

Referring now to FIG. 5, a joint 66, identical to that shown in FIG. 1, has its cross-piece 68 embedded by moulding in a panel 92 of expanded polystyrene, foamed polyurethane or the like. The joint can thus be used to connect the panel to the spherical connector in the same way as the tubes described above. Depending on the desired orientation of the panel in the structure, the joint may be moulded in with its tongue 72 at right angles to the plane of the panel as shown in FIG. 5, planar with the panel as shown in broken lines, or in any other desired orientation.

Figure 6:
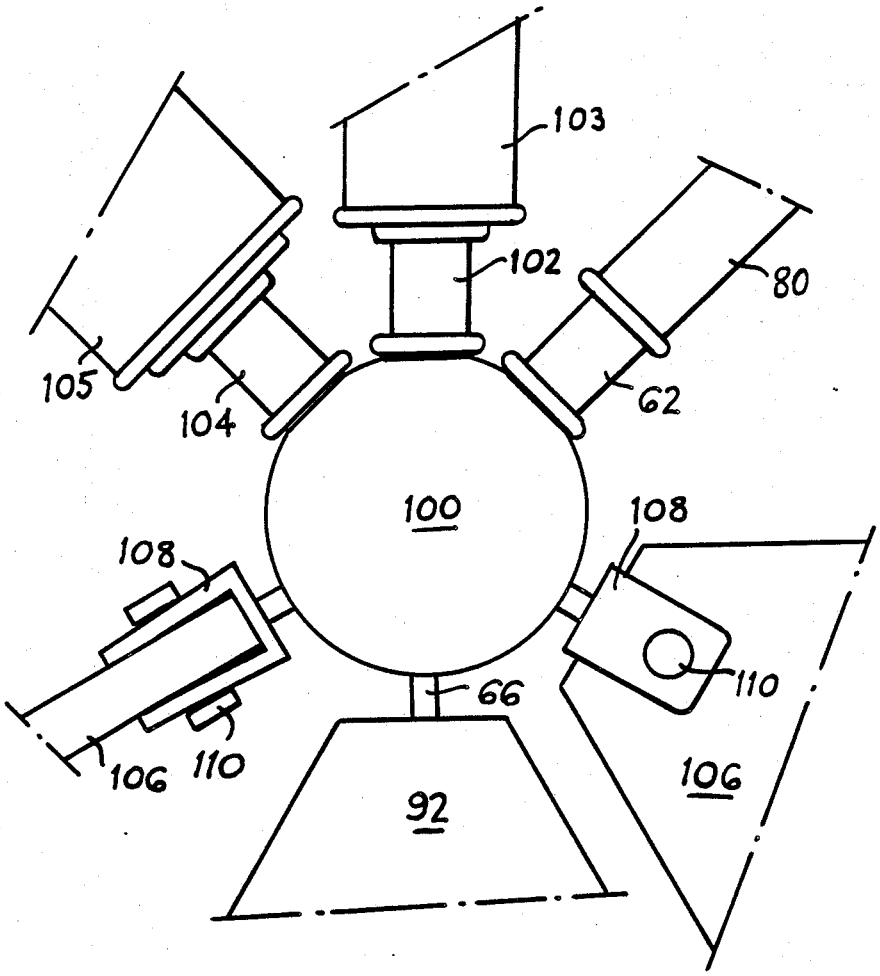
FIG. 6 shows schematically how several different structural members can be connected together using the connector of FIG. 1.

FIG. 6 shows how three tubes and 3 panels can be connected to a single spherical connector 100. Tubes 80,103 and 105 of different diameter are connected by respective cylindrical connectors 62,102 and 104, as described in connection with FIG. 1 to 4, serrations 45 in the channel 48 helping to retain the tubes in the relative angular disposition shown.

Also connected to the spherical connector are a panel 92 connected by an integrally moulded joint 66 as in FIG. 5 and two panels 106, one coplanar with the panel 92 and one at right angles to it. The two panels 106 are secured by brackets 108 which are themselves secured in the channel 48 by means of tongues, in the same way as the other connectors. The panels are secured in the brackets by bolts 110.

Some possible modifications to the cylindrical connector are shown in FIG. 7. Here, the connecting tongue 172 is secured to the spherical connector by a spring 170 to which it is adhesively bonded. At its other end the spring is bonded to a disc 168 which is secured in a cylindrical connector formed by bonding together two semi-cylindrical halves 162,164, the disc being held between a thick end wall 173 and a thinner wall 174 behind it. To ensure stability and prevent rocking of the cylindrical connector relative to the spherical one an annular flange 178 is provided on the end wall 173 to bear against the spherical connector surface. In this embodiment the integral projections 82 are replaced by annular rubber gaskets 182.

Tubes which are connected using the connectors of the invention are not confined to a rigid configuration but have a degree of play allowed by the resilience of the hard rubber joints 66 or springs 170. Furthermore, because the channels 48,52,54 are continuous, tubes can be supported by these channels at any desired angle relative to one another. Indicia such as 88 are provided on the surface of he spherical connector to assist in the positioning of the tubes.

FIGS. 8 and 9 illustrate typical triangulated structures which can be constructed from tubes 80 and connectors 90 according to the invention. Such structures can be put together without dismantling any spherical connectors, simply by sliding the intermediate connector into the end of each tube, inserting the tongue 72 into one of the channels 48,52,54 or slots 28,38 and rotating the tube through 90° about its longitudinal axis to secure the connection. Similar structures can be made to include panels.

The hard rubber connectors 66 and springs 70 are under slight tension in the assembled space frame, so that the entire structure is under slight inward tension, increasing its rigidity and stability.

FIGS. 10 and 11 show, in end view and in axial cross-section respectively, a tongue connector assembly for use in accordance with another embodiment of the invention. This includes a rigid connector 200 which is similar to the connectors 66 except that its tongue portion 204 has rounded surfaces 205 to match corresponding abutment surfaces in a modified spherical connection which will be described below. Like the connector 66, the connector 200 has an elongate connecting portion 208 and, at its end remote from the tongue, a retaining portion 206. In this case however the retaining portion is cross-shaped.

The next part of the assembly is a spacer member 201, suitable of hard rubber, to provide a degree of resilience which is annular in shape with a central opening 209 having four radial recesses 210 so that its shape matches the cross-shaped retaining portion 206 of the connector 200, which can pass through it. One side surface 212 of the spacer is part spherical in shape, to match the outer surface of a spherical connector. The opposite side has a shallow recess 211, to accommodate one end of the next part of the assembly which is a bushing 202. This has a widened end 214 fitting into the recess 211 and a threaded portion 216 to enable the whole assembly to be screwed into a structural member or a further connector to which the structural member can be attached. The bushing 202 has an axial passage 215 therethrough, the cross section of this passage being identical with that of the spacer 201 to enable the end 206 of the tongue connector 200 to pass through it.

The last member of the assembly is a part-annular collar 203 having on one side a recess 219 which is circular in outline and surrounds a central circular part of an opening 218. This collar fits over the connector 200 to retain it in the bushing 202, the central part of the opening 218 fitting over the elongate central part 208 of the connector and the retaining portion 206 abutting the recessed portion 219 of the collar.

FIG. 12 shows one type of intermediate connector into which the assembly of FIGS. 10 and 11 may fit. This connector includes a flat bar 220 with an aperture 224 to accommodate a screw connector or the like to connect a panel to the bar. At one end of the bar is a connecting portion 221 with a threaded bore 222 into which may be screwed the bushing 202 through which is inserted the tongue connector 200. The retaining portion 206 of the tongue connector together with the collar 203, will be received in a recess 223 at the inner end of the threaded bore 222.

Figure 13:
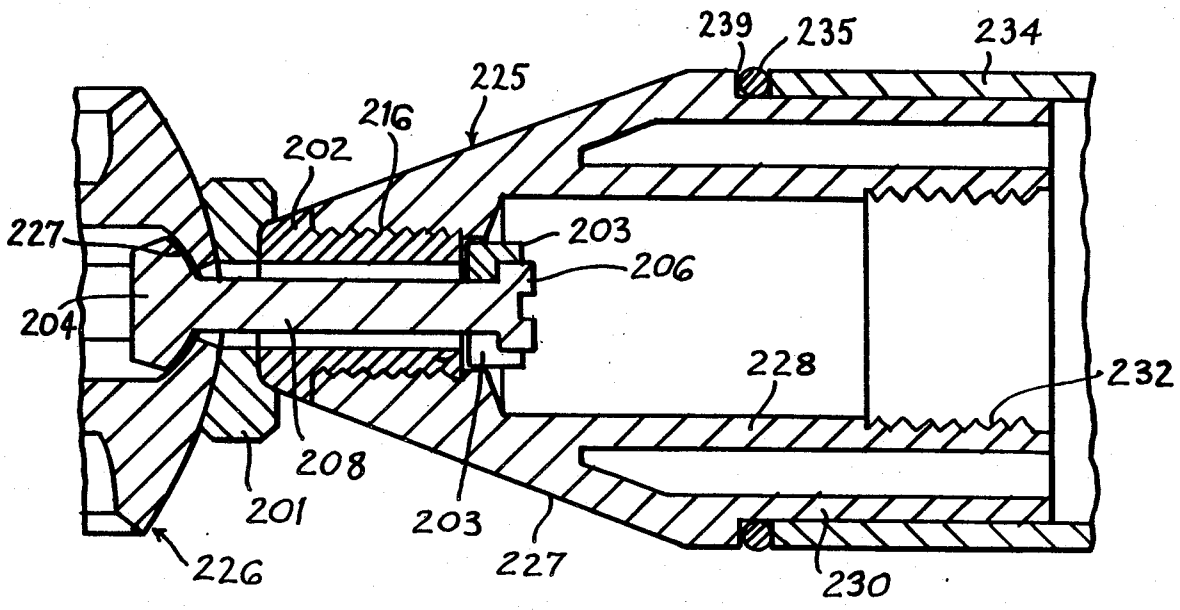
FIG. 13 is a cross-sectional view of part of a connector in accordance with a further embodiment of the invention connected to a tubular member by the tongue assembly of FIGS. 10 and 11 and FIG. 14 shows a connecting member in the form of a lamp support for use with the 3-dimensional structure of the invention.

FIG. 13 shows how the assembly of FIGS. 10 and 11 can be used to connect a modified spherical connector 226 to an intermediate connector 225 to which can be connected in turn, for example, a tubular structural member 234. The spherical connector is similar to that shown in FIG. 1 except that the abutment surfaces 227 are of arcuate cross-section rather than flat. They thus match the arcuate surfaces 205 of the retaining tongue 204 of the connector 200.

As has been briefly described above, the elongate central portion 208 of the connector 200 passes through the annular spacer 201, the bushing 202 and the retaining collar 203. The intermediate connector 225 is then screwed on to the assembly, the threaded portion 216 of the bushing being received into a correspondingly threaded axial bore at one end of the connector 225.

The connector 225 is shown accommodating a tubular structural member 234 of relatively large diameter, this fitting over a wide cylindrical portion 230 of the connector 225, the end of the tube being spaced from an annular shoulder 239 of the connector 225 by a rubber washer 235. From the widened cylindrical part 230 the connector tapers at 227 inwardly towards the bore which receives the bushing 202.

Coaxially within the wide cylindrical part 230 of the intermediate connector 225 is a second cylindrical part 228 of small diameter which has, at the end opposite to the bushing 202, a threaded axial bore 232 into which another structural member such as a rod may be screwed.

It will be appreciated that a wide variety of different types of intermediate connector can be secured to the spherical connector 226 with the assembly shown, to accommodate different sizes and shapes of structural members.

Figure 14:
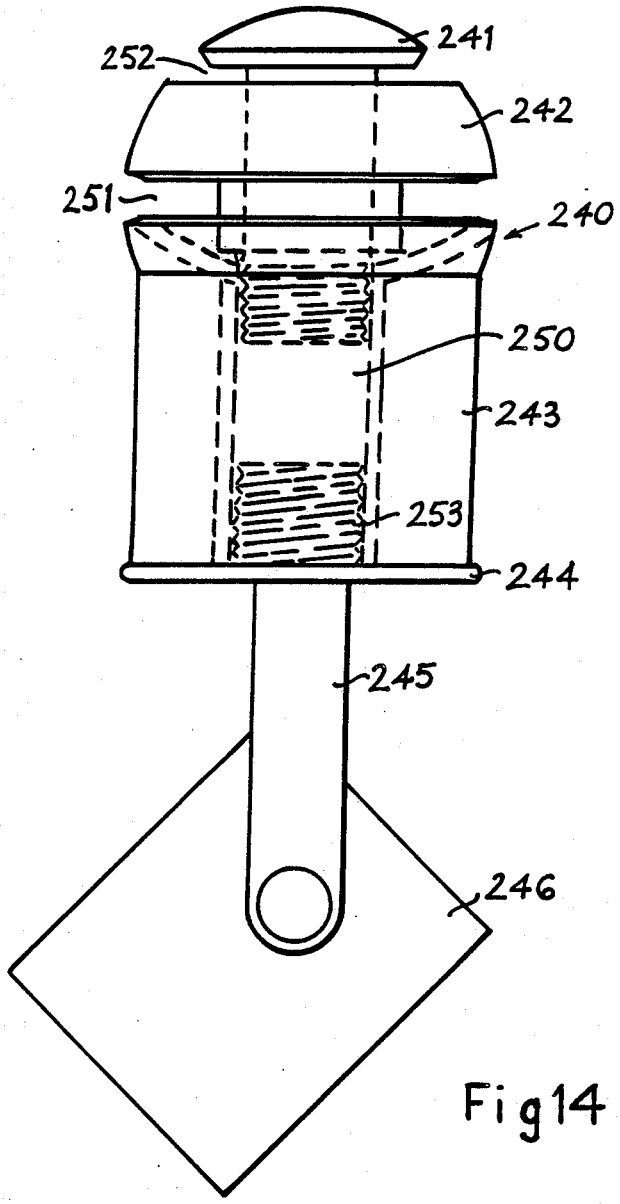

In the assembly shown in FIG. 14, two parts of a spherical connector such as that shown in FIG. 13, namely a core member 241 and an annular member 242, are screwed into a cylindrical support 243 which has a central threaded bore 250. Two annular channels 251,252 are thus defined which can be used to accommodate structural members as already described above.

Into the opposite end of the threaded bore 250 is screwed a base 244, with a screw threaded central shank 253, to which is secured a bracket 245 holding a spotlamp 246. This assembly can thus be secured at any convenient part of the three-dimensional structure being connected to other structural members in the same way as the spherical connectors of the invention.

Wiring for the lamp can pass through an aperture in the bracket 245, through the bore 250 and through the central bore of the core member 241 before passing out through the axial slot of the core member. Thereafter it can if desired pass through an aperture such as 67 in an intermediate connector and along a tube connected to it.

It will be appreciated that various other structural members and accessories can be incorporated into a structure formed in accordance with the invention. For example, in place of the support bracket for a spotlamp, a flat base could be secured to the underside of the cylindrical support 243 and used either to support the structure on the floor or to be secured to the floor or ceiling.

What is claimed is:

1. A spherical connector for connecting structure members by respective ends thereof to form a 3-dimensional structure, comprising:

a core with a substantially cylindrical central portion having, at each axial end, a part-spherical end portion wider than the cylindrical central portion, said core being formed of a pair of coil portions, each of which has one of said part-spherical end portions;

first and second apertures in the form of elongate slots, each formed in a part-spherical outer surface of a respective one of said end portions, a hollow region extending within the cylindrical central portion of the core and being adjacent to each said slot to enable a tongue on one said structural member having a widened free end, elongate in end view and tapering inwardly from its free end in plan view, to be inserted and retained by rotating it through 90° about a common axis of said connector passing through both said slots;

a pair of bearing surfaces formed within said hollow region and diverging from one another from respective opposed longitudinal edges of each said slot in a direction away from said part-spherical outer surface; and a pair of annular members mounted on and surrounding the cylindrical central portion of the core and having respective annular outer portions, with part spherical outer surfaces connected by annular webs to respective cylindrical portions surrounding the cylindrical central portion of said core, and defining therebetween an annular channel extending circumferentially and entirely around said connector to form a third aperture to receive a plurality of said tongues, said annular channel including a median plane of said connector perpendicular to said core and having a radially outer constriction towards which extend a pair of annular bearing surfaces within said channel, one formed on each of said annular members with its wider circumference adjacent a respective edge of said constriction;

wherein a secondary channel is defined between each said end portion of said core and a respective one of said annular members, said secondary channels constituting respective fourth and fifth apertures to receive further said tongues and each having therein a pair of annular bearing surfaces which converge towards one another in a radially outward direction, one of said annular bearing surfaces extending from the cylindrical central portion of said core to a circumferential edge of the respective end portion and the other being an inner surface of the respective annular member extending from its part-spherical outer surface to the respective annular web.

2. A three-dimensional structure wherein a plurality of structural members are connected together by at least one spherical connector according to claim 1, each of the structural members being connected to the connector by means of a tongue projecting from said structural member and having a widened free end elongate in end view and with outwardly tapering bearing surfaces in plan view, the tongue being inserted into one of said first, second, third, fourth and fifth apertures of the connector and rotated through 90° to retain it therein by engagement of said outwardly tapering bearing surfaces with corresponding bearing surfaces within the aperture.

3. A three-dimensional structure as claimed in claim 2, wherein a resilient spacer is positioned around said tongue between at least one of said structural members and said at least one connector to which it is attached.

4. A three-dimensional structure as claimed in claim 2 wherein said tongue is formed at a free end of an elongated joint of resilient material retained in and projecting from an intermediate connector.

5. A three-dimensional structure as claimed in claim 4 wherein a tubular structural member is fitted over said intermediate connector.

6. A three-dimensional structure as claim in claim 4 wherein a panel is secured to said intermediate connector.

7. A three-dimensional structure as claimed in claim 4 wherein said elongated joint is retained in a threaded bushing which is screwed into said intermediate connector.

* * * * *